US007410231B2

(12) United States Patent
Zhao et al.

(10) Patent No.: US 7,410,231 B2
(45) Date of Patent: Aug. 12, 2008

(54) PEN VOLTAGE REGULATOR FOR INKJET PRINTERS

(75) Inventors: Yu Zhao, Singapore (SG); Chiew-Teng Toh, Singapore (SG); Yih-Shun Ng, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 340 days.

(21) Appl. No.: 11/277,032

(22) Filed: Mar. 20, 2006

(65) Prior Publication Data

US 2007/0216715 A1 Sep. 20, 2007

(51) Int. Cl.
*B41J 29/38* (2006.01)

(52) U.S. Cl. ..... 347/9; 347/10

(58) Field of Classification Search ..... 347/9, 347/10

See application file for complete search history.

(56) References Cited

U.S. PATENT DOCUMENTS 5,278,489 A * 1/1994 Bowers ..... 323/225
6,439,678 B1 8/2002 Norton
6,481,814 B2 11/2002 DeMoor et al.
2005/0041049 A1 2/2005 Masuda
2005/0248894 A1 11/2005 Bliley et al.

* cited by examiner

*Primary Examiner*—Julian D Huffman

(57) ABSTRACT

A pen voltage regulator is provided for supplying a regulated pen voltage to one or more printheads of an inkjet printer. The pen voltage regulator includes: a regulator switch arranged between an input terminal and an output terminal; a linear lifting circuit connected to the regulator switch; a soft start circuit arranged between the regulator switch and the output terminal; an output filter arranged between the soft start circuit and the output terminal; and a pulse width modulation (PWM) controller connected to the linear filtering circuit. The PWM controller is arranged to provide a pulse width modulated control signal to the linear filtering circuit. The linear filtering circuit is configured to transmit a smoothed control signal to the regulator switch and to ensure that the regulator switch is operable in a linear region. The soft start circuit is configured to provide a soft-start mode of operation so as to prevent the generation of large inrush currents and to provide overload protection.

21 Claims, 2 Drawing Sheets

PEN VOLTAGE REGULATOR FOR INKJET PRINTERS

BACKGROUND

Conventional thermal inkjet printers are provided with a plurality of printheads for firing drops of ink. A sufficient amount of energy must be applied to the printheads to properly fire the drops of ink. If the applied energy is too low, there may not be enough energy to drive the printhead to eject ink drop, or the velocity of the drop may be too low, thereby resulting in defects in the printed image. If the applied energy is too high, the printheads may get too hot resulting in decreased pen life. For these reasons, accurate energy control is essential for proper operation of the printheads. Typically, a switching voltage regulator is used to supply the desired electrical energy to the printheads. The voltage regulator is configured to receive direct current electrical energy from a power supply source and convert the direct current voltage to a regulated output voltage for use by the printheads. Conventional voltage regulators include step-down Buck controllers and other power components that increase the size and cost of the printers. It generally requires a more complex power supply system to drive the printheads. Therefore, there remains a need for a simple power voltage regulator that can be implemented at a low cost and can be installed in a smaller sized printer.

SUMMARY

The present invention provides a pen voltage regulator for supplying a regulated pen voltage to one or more printheads of an inkjet printer. The pen voltage regulator includes: a regulator switch arranged between an input terminal and an output terminal; a linear filtering circuit connected to the regulator switch; a soft start circuit arranged between the regulator switch and the output terminal; an output filter arranged between the soft start circuit and the output terminal; and a pulse width modulation (PWM) controller connected to the linear filtering circuit. The PWM controller is arranged to provide a pulse width modulated control signal to the linear filtering circuit. The linear filtering circuit is configured to transmit a smoothed control signal to the regulator switch and to ensure that the regulator switch is operable in a linear region. The soft start circuit is configured to provide a soft-start mode of operation so as to prevent the generation of large inrush currents and to provide overload protection.

The objects, features and advantages of the present invention will become apparent from the detailed description when read in conjunction with the drawings.

DETAILED DESCRIPTION

Figure 1:
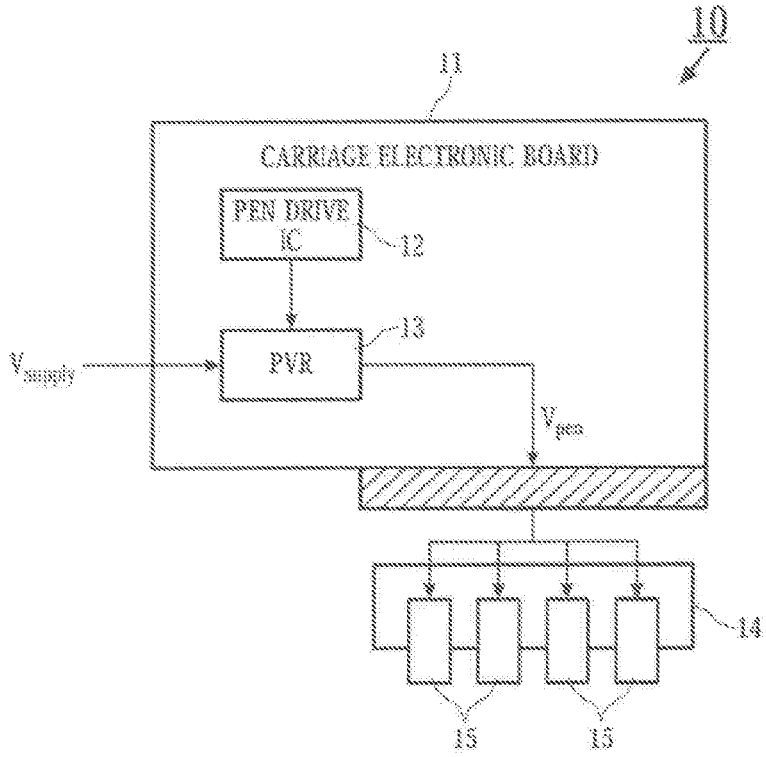
FIG. 1 schematically shows an inkjet pen system having a pen voltage supply circuit in accordance with an embodiment.

FIG. 1 schematically shows an inkjet pen system 10 having a pen voltage regulator. The inkjet pen system 10 includes a carriage electronic board 11, on which a pen driver integrated circuit (IC) 12 and a pen voltage regulator 13 are mounted.

The carriage electronic board 11 is attached to a carriage 14, which supports a plurality of ink pens 15. The ink pens 15 are provided with printheads for ejecting ink droplets onto a printed media. The pen driver IC 12 is operable to control the firing energy to the printheads. The pen voltage regulator 13 is configured to regulate the supply voltage $V_{supply}$ to an accurate and stable pen voltage $V_{pen}$ for driving the printheads of the ink pens (i.e. the loads).

Figure 2:
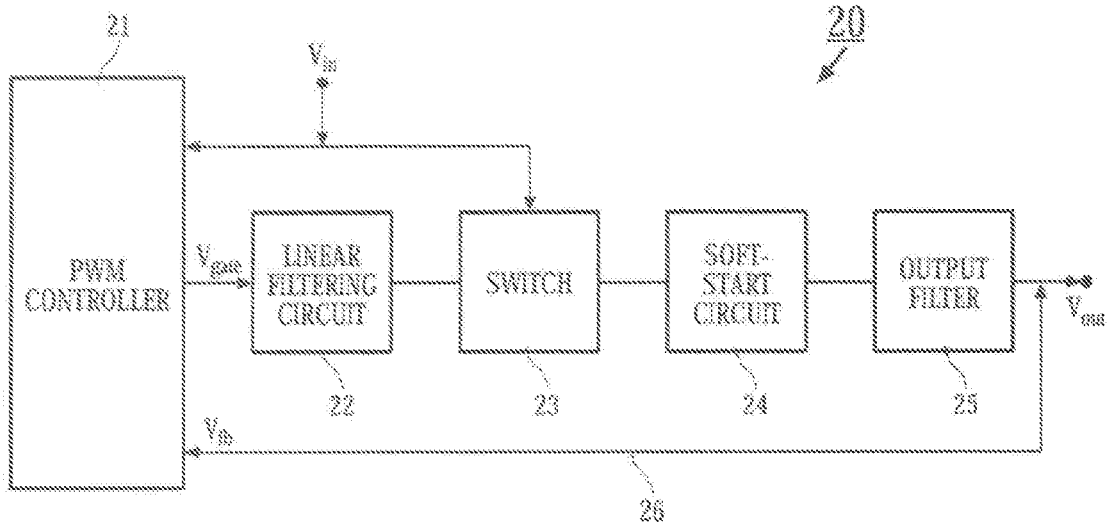
FIG. 2 shows a schematic diagram of a pen voltage regulator circuit in accordance with one embodiment.

FIG. 2 shows an embodiment of a pen voltage regulator circuit 20 for supplying a regulated pen voltage to the printheads of an inkjet printer. The pen voltage regulator circuit 20 includes a pulse width modulation (PWM) controller 21, a linear filtering circuit 22, a regulator switch 23, a soft start circuit 24, and an output filter 25, arranged as shown in FIG. 2.

Referring to FIG. 2, the regulator switch 23 is arranged between an input terminal $V_{in}$ and an output terminal $V_{out}$. In one embodiment, the regulator switch 23 is a power transistor. The input terminal $V_{in}$ is directly connected to printer power supply, i.e., an unregulated DC source (not shown). The soft start circuit 24 is arranged between the regulator switch 23 and the output terminal $V_{out}$. The output filter 25 is arranged between the soft start circuit 24 and the output terminal $V_{out}$. A feedback trace 26 is coupled to the output voltage terminal $V_{out}$ to provide a feedback signal representative of the output voltage.

The input terminal $V_{in}$ is configured to receive an unregulated input voltage. The PWM controller 21 is arranged to supply a pulse width modulated control signal $V_{gate}$ to the linear filtering circuit 22. The filtering circuit 22 is configured to generate a smoothed voltage for driving the regulator switch 23 and to ensure that the regulator switch 23 is operable in the linear region. The output from the regulator switch 23 is fed to the soft start circuit 24, which is configured to provide a soft-start mode of operation so as to reduce or prevent the generation of large inrush currents and to provide overload protection. The output of the soft-start circuit is filtering by the output filter 25 to generate a smoothed output voltage at output terminal $V_{out}$. The feedback trace 26 delivers to the PWM controller 21 a feedback signal $V_{in}$ representative of the output voltage at $V_{out}$ and the control signal $V_{gate}$ is responsive to the feedback signal. The output voltage at output terminal $V_{out}$ is used to drive on ore more printheads. As such, the overall effect of the pen voltage regulator circuit 20 is that the unregulated supply voltage is regulated to a programmable voltage that is required for driving the printheads.

The PWM controller 21, the linear filtering circuit 22 and the regulator switch 23, together form a low dropout voltage regulator. In a low dropout voltage regulator, the difference between the input voltage (unregulated voltage) and the output voltage (regulated voltage) is relatively low. Consequently, a stable output voltage can be provided by using this type of voltage regulator.

Figure 3:
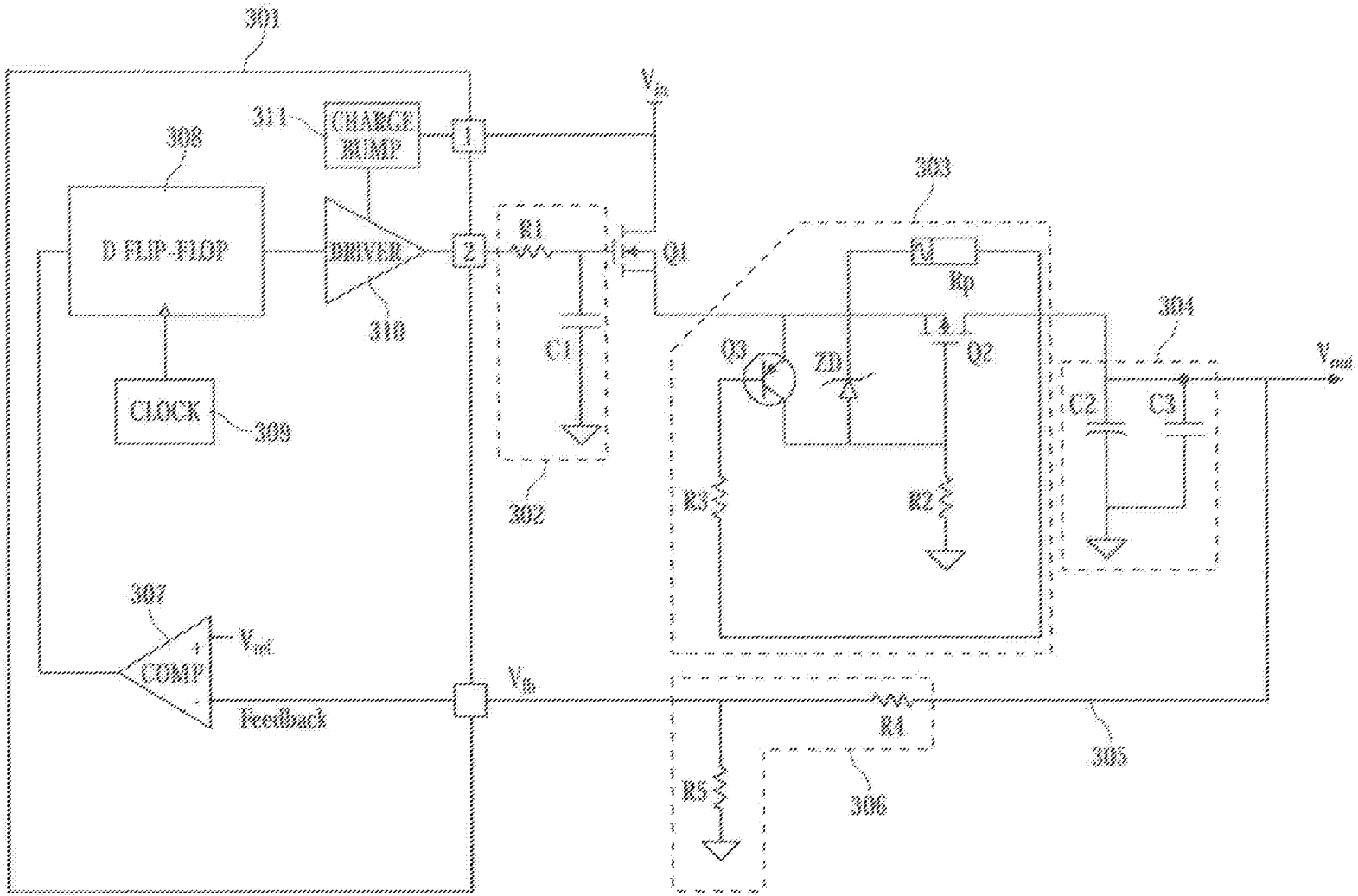
FIG. 3 shows a schematic diagram of a pen voltage regulator circuit in accordance with another embodiment.

FIG. 3 shows a schematic diagram of a pen voltage regulator circuit 300 in accordance with another embodiment. The pen voltage regulator circuit 300 includes a PWM controller 301, a linear filtering circuit 302, a power transistor Q1, a soft-start circuit 303, and an output filter 304. The power transistor Q1, the soft-start circuit 303 and the output filter 304 are arranged between an input terminal $V_{in}$ and an output terminal $V_{out}$. The drain of power transistor Q1 is connected to the input terminal $V_{in}$. The power transistor Q1 may be a metal oxide semiconductor field effect transistor (MOSFET) or a bipolar junction transistor (BJT).

The pen voltage supply circuit 300 further includes a feedback network which includes a feedback trace 305 and a voltage driver 306. The voltage driver 306 includes resistors R4 and R5 which are arranged to provide a feedback voltage $V_{fb}$ that is representative of the output voltage $V_{out}$. The PWM controller 301 includes a comparator 307 arranged to receive the feedback voltage $V_{fb}$ and compare that to a reference voltage $V_{ref}$, which is internally programmed by the controller. The result of this comparison is fed to a D flip-flop 308, which is running at a preset frequency of a clock signal. The clock signal is provided by an internal clock 309. The Q output of D flip-flop 308 is fed to a gate driver 310 to generate a pulse width modulated signal, which is fed to a PWM output pin 2. During operation, at each rising edge of the clock signal, controller 301 monitors the output feedback from comparing $V_{in}$ with $V_{ref}$ to determine if the gate driver 310 needs to pass a "1" or "0" on the input of the linear filtering circuit 302. If the output voltage $V_{out}$ is lower than programmed voltage (i.e., $V_{fb}$ less than $V_{ref}$), the PWM controller will output "1" to get higher voltage on the gate of transistor Q1 and to increase the output voltage. Conversely, the PWM controller will output "0" when the output voltage $V_{out}$ is higher than the programmed value. As a result, the output voltage at $V_{out}$ is controlled according to $V_{ref}$.

Input pin 1 is coupled to input terminal $V_{in}$ to provide driving voltage to the gate driver 310 via a charge bump 311. The linear filtering circuit 302 includes resistor R1 and capacitor C1. Resistor R1 is coupled between the PWM output pin 2 and the gate of transistor Q1. Capacitor C1 is coupled between the gate of transistor Q1 and ground. The resistor R1 and capacitor C1, together filter out the AC component of the pulse width modulated signal from the gate driver to provide a smoothed voltage for driving the transistor Q1 and to ensure that the transistor Q1 is operable in the linear region.

The soft-start circuit includes a bipolar PNP transistor Q3, a P-channel power transistor (e.g. MOSFET) Q2, a zener diode ZD, a poly-switch Rp (e.g. a positive temperature coefficient (PTC) resistor), and two resistors R2 and R3. The emitter of the bipolar transistor Q3 is connected to the source of transistor Q1 and the collector of bipolar transistor Q3 is connected to the gate of power transistor Q2. The poly-switch Rp is coupled between the source and drain of the power transistor Q2. The zener diode ZD is arranged in parallel with the bipolar transistor Q3 to provide over-voltage protection on the gate of power transistor Q2. The resistor R3 is coupled between the base of bipolar transistor Q3 and the output capacitors C2 & C3. The resistor R2 is coupled between the gate of power transistor Q2 and ground.

The output filter 304 includes bulk output capacitors C2 and C3, which are arranged in parallel between the power transistor Q2 and the output terminal $V_{out}$. The output capacitors C2 and C3, when they are charged, provide a smoothed output voltage at the output terminal $V_{out}$.

During the start-up phase of the pen voltage supply circuit 300, the power transistor Q1 is supplied with a supply voltage from $V_{in}$. The power transistor Q2 is off and the transistor Q3 is on. The current delivered by the power transistor Q1 flows through transistor Q3 base via resistor R3 and poly-switch Rp. The resistor R3 is arranged to ensure that the power transistor Q2 is off during this start-up phase. As a result, the poly-switch Rp charges the output capacitors C2 and C3 with a relatively small current. Bipolar transistor Q3 turns off when the output capacitors C2 and C3 are charged close to the output voltage. Consequently, no current flows through the base of transistor Q3 to turn off the collector of transistor Q3. At this time, power transistor Q2 turns on, thereby allowing a low-resistance current path across transistor Q2.

As the current through power transistor Q2 increases, the voltage drop across power transistor Q2 also increases due to its internal resistance. When the voltage drop across power transistor Q2 increases to a threshold level, bipolar transistor Q3 is turned on, and power transistor Q2 is turned off, thereby forcing the current to flow through the poly-switch Rp. As a consequence, short circuit protection is provided. Furthermore, removing the output fault condition resumes normal operation. Zener diode ZD and resistor R2 provide a proper bias on the gate of transistor Q2 when transistor Q2 is turned on, while the resistance of resistor R3 is designed to adjust the turn-on sensitivity of bipolar transistor Q3.

The pen voltage regulator of the present invention, as described in the embodiments above, provides a simple power distribution architecture for the printer. Furthermore, there is no switching noise or ripple voltage related to the supply voltage, resulting in low EMI (electromagnetic interface). One major advantage of the pen voltage regulator of the present invention is that the regulator can be implemented using smaller electronic components. Consequently, it is possible to implement a smaller carriage electronic board, thereby reducing the size of the printer as well as reducing the manufacturing cost of the carriage electronic board.

It is intended that that the embodiments contained in the above description and shown in the accompanying drawings are illustrative and are not limiting. It will be clear to those skilled in the art that modifications may be made to the embodiments without departing from the scope of the invention as defined by the appended claims.

What is claimed is:

1. A pen voltage regulator for supplying a regulated pen voltage to drive one or more printheads of an inkjet printer, said pen voltage regulator comprising:

a regulator switch arranged between an input terminal and an output terminal;

a linear filtering circuit connected to the regulator switch;

a soft start circuit arranged between the regulator switch and the output terminal;

an output filter arranged between the soft start circuit and the output terminal;

a pulse width modulation (PWM) controller connected to the linear filtering circuit; and wherein the PWM controller is arranged to provide a pulse width modulated control signal to the linear filtering circuit, the linear filtering circuit is configured transmit a smoothed control signal to the regulator switch and to ensure that the regulator switch is operable in a linear region, and the soft start circuit is configured to prevent the generation of large inrush currents and to provide overload protection.

2. The pen voltage regulator of claim 1 further comprising:

a feedback network coupled to the output voltage terminal and configured to provide a feedback signal representative of an output voltage at the output terminal, wherein the pulse width modulated control signal is responsive to the feedback signal.

3. The pen voltage regulator of claim 1, wherein the regulator switch is a first power transistor having a gate.

4. The pen voltage regulator of claim 3, wherein the linear filtering circuit comprises a resistor and a capacitor, the resistor being coupled between an output of the PWM controller and the gate of the power transistor, and the capacitor being coupled between the gate of the power transistor and ground.

5. The pen voltage regulator of claim 1, wherein soft-start circuit comprises:

a bipolar transistor having an emitter, a collector and a base;

a power transistor having a gate, a source and a drain;
a zener diode;
a poly-switch;
a first resistor; and
a second resistor,
wherein the emitter of the bipolar transistor is connected to the source of the power transistor, and the collector of bipolar transistor is connected to the gate of power transistor, the poly-switch is coupled between the source and drain of the power transistor, the zener diode is arranged in parallel with the bipolar transistor, the first resistor is coupled between the base of bipolar transistor and an input of the output filter, and the second resistor is coupled between the gate of power transistor and ground.

6. The pen voltage regulator of claim 1, wherein the output filter comprises two capacitors arranged in parallel so as to provide a smoothed voltage at the output terminal.

7. The pen voltage regulator of claim 1, wherein the feedback network comprises a voltage divider.

8. The pen voltage regulator of claim 1, wherein the PWM controller, the linear filtering circuit and the regulator switch, together form a low dropout voltage regulator.

9. An inkjet pen system comprising:
at least one inkjet pen having a printhead for ejecting ink droplets;
a pen voltage regulator for supplying a regulated pen voltage to drive the printhead, said pen voltage regulator comprising:
a regulator switch arranged between an input terminal and an output terminal;
a linear filtering circuit connected to the regulator switch;
a soft start circuit arranged between the regulator switch and the output terminal;
an output filter arranged between the soft start circuit and the output terminal;
a pulse width modulation (PWM) controller connected to the linear filtering circuit; and
wherein the PWM controller is arranged to provide a pulse width modulated control signal to the linear circuit, the linear filtering circuit is configured transmit a smoothed control signal to the regulator switch and to ensure that the regulator switch is operable in a linear region, and the soft start circuit is configured to prevent the generation of large inrush currents and to provide overload protection.

10. The inkjet pen system of claim 9 further comprising:
a feedback network that is coupled to the output terminal and is configured to provide a feedback signal representative of the output voltage at the output terminal,
wherein the pulse width modulated control signal is responsive to the feedback signal.

11. The inkjet pen system of claim 9, wherein the regulator switch is a power transistor having a gate.

12. The inkjet pen system of claim 11, wherein the linear filtering circuit comprises a resistor and a capacitor, the resistor being coupled between an output of the PWM controller and the gate of the power transistor, and the capacitor being coupled between the gate of the power transistor and ground.

13. The inkjet pen system of claim 9, wherein soft-start circuit comprises:
a bipolar transistor having an emitter, a collector and a base;
a power transistor having a gate, a source and a drain;
a zener diode;
a poly-switch;
a first resistor; and
a second resistor,
wherein the emitter of the bipolar transistor is connected to the source of the power transistor, and the collector of bipolar transistor is connected to the gate of power transistor, the poly-switch is coupled between the source and drain of the power transistor, the zener diode is arranged in parallel with the bipolar transistor, the first resistor is coupled between the base of bipolar transistor and an input of the output filter, and the second resistor is coupled between the gate of power transistor and ground.

14. The inkjet pen system of claim 9, wherein the output filter comprises two capacitors arranged in parallel so as to provide a smoothed voltage at the output terminal.

15. The inkjet pen system of claim 9, wherein the feedback network comprises a voltage divider.

16. The inkjet pen system of claim 9, wherein the PWM controller, the linear filtering circuit and the regulator switch, together form a low dropout voltage regulator.

17. A method for applying a regulated voltage to one or more printheads in an inkjet printer, said method comprising:
providing a first power transistor having a gate;
coupling a linear filtering circuit to the gate of the power transistor, the linear filter circuit being configured to ensure that the power transistor is operable in a linear region;
supplying the power transistor with an unregulated supply voltage;
generating a pulse width modulated control signal;
transmitting the pulse width modulated control signal to the linear filtering circuit in order to generate a smoothed control signal;
transmitting the smoothed control signal to the power transistor;
delivering the output of the power transistor to a soft-start circuit to implement a soft-start operation, the soft-start circuit being configured to prevent the generation of large inrush currents and to provide overload protection;
filtering the output of the soft-start circuit so as to generate a smoothed output voltage; and
applying the output voltage to at least one inkjet printhead.

18. The method according to claim 15 further comprising:
generating a feedback voltage representative of the output voltage;
comparing the feedback voltage to a reference voltage and generating the pulse width modulated control signal based thereon.

19. The method according to claim 15, wherein soft-start circuit comprises:
a bipolar transistor having an emitter, a collector and a base;
a second power transistor having a gate, a source and a drain;
a zener diode;
a poly-switch;
a first resistor; and
a second resistor,
wherein the emitter of the bipolar transistor is connected to the source of the power transistor, and the collector of bipolar transistor is connected to the gate of power transistor, the poly-switch is coupled between the source and drain of the power transistor, the zener diode is arranged in parallel with the bipolar transistor, the first resistor is coupled between the base of bipolar transistor and an input of the output filter, and the second resistor is coupled between the gate of power transistor and ground.

20. The method according to claim 19, wherein filtering the output of the soft-start circuit is performed by output capacitors, and during a start-up phase, the bipolar transistor is on and the second power transistor is off, and the current delivered by the first power transistor flows through the bipolar transistor and the poly-switch.

21. The method according to claim 20, wherein, when the output capacitors are charged close to the output voltage, the bipolar transistor turns off and the second power transistor turns on, thereby allowing a current path across the second power transistor.

* * * * *

UNITED STATES PATENT AND TRADEMARK OFFICE

CERTIFICATE OF CORRECTION

PATENT NO. : 7,410,231 B2
APPLICATION NO. : 11/277032
DATED : August 12, 2008
INVENTOR(S) : Yu Zhao et al.

It is certified that error appears in the above-identified patent and that said Letters Patent is hereby corrected as shown below:

On the face page, in field (57), under "Abstract", in column 2, line 5, delete "lifting" and insert -- filtering --, therefor.

In column 2, line 38, delete "filtering" and insert -- filtered --, therefor.

In column 2, line 42, before "feedback" delete "the" and insert -- this --, therefor.

In column 2, line 43, delete "on ore" and insert -- one or --, therefor.

In column 3, line 1, before "306." delete "driver" and insert -- divider --, therefor.

In column 3, line 1, before "306 includes" delete "driver" and insert -- divider --, therefor.

In column 3, line 14, delete "$V_{in}$" and insert -- $V_{fb}$--, therefor.

In column 3, line 16, after "than" insert -- the --.

In column 3, line 20, after "voltage" insert -- at --.

In column 4, lines 17-18, delete "interface" and insert -- interference --, therefor.

In column 4, line 26, after "and" delete "are".

In column 4, line 45, in Claim 1, after "configured" insert -- to --.

In column 5, line 41, in Claim 9, after "linear" insert -- filtering --.

In column 5, line 42, in Claim 9, after "configured" insert -- to --.

UNITED STATES PATENT AND TRADEMARK OFFICE

CERTIFICATE OF CORRECTION

PATENT NO. : 7,410,231 B2
APPLICATION NO. : 11/277032
DATED : August 12, 2008
INVENTOR(S) : Yu Zhao et al.

It is certified that error appears in the above-identified patent and that said Letters Patent is hereby corrected as shown below:

In column 6, line 50, in Claim 19, after "wherein" insert -- the --.

Signed and Sealed this

Eighteenth Day of November, 2008

JON W. DUDAS
*Director of the United States Patent and Trademark Office*